United States Patent [19]

Sara

[11] 4,424,145

[45] Jan. 3, 1984

[54] CALCIUM INTERCALATED BORONATED CARBON FIBER

[75] Inventor: Ramond V. Sara, Parma, Ohio

[73] Assignee: Union Carbide Corporation, Danbury, Conn.

[21] Appl. No.: 486,459

[22] Filed: Apr. 25, 1983

Related U.S. Application Data

[63] Continuation of Ser. No. 276,158, Jun. 22, 1981, abandoned.

[51] Int. Cl.[3] ..... D01F 9/14; D01F 11/00

[52] U.S. Cl. ..... 252/509; 106/307; 252/502; 252/503; 252/506; 264/29.2; 423/447.1; 423/447.2; 423/447.3; 423/447.7; 423/460

[58] Field of Search ..... 252/502, 503, 506, 509; 106/307; 423/447.1, 447.2, 447.3, 447.7, 460

[56] References Cited

U.S. PATENT DOCUMENTS

| | | | |
|---|---|---|---|
| 3,974,264 | 8/1976 | McHenry | 423/447.4 |
| 4,169,808 | 10/1979 | Klemann et al. | 252/518 |
| 4,237,061 | 12/1980 | Johnson | 260/429.5 |
| 4,292,253 | 9/1981 | Ozin et al. | 260/429.5 |

FOREIGN PATENT DOCUMENTS

| | | |
|---|---|---|
| 49-123336 | 12/1974 | Japan . |
| 1295289 | 11/1972 | United Kingdom . |

*Primary Examiner*—Stanford M. Levin
*Attorney, Agent, or Firm*—David Fink

[57] ABSTRACT

A mesophase pitch derived carbon fiber which has been boronated and intercalated with calcium possesses a low resistivity and excellent mechanical properties.

7 Claims, No Drawings

CALCIUM INTERCALATED BORONATED CARBON FIBER

This application is a continuation of application Ser. No. 276,158, filed June 22, 1981 now abandoned.

The invention relates to a mesophase pitch derived carbon fiber and particularly to a carbon fiber which has been boronated and intercalated with calcium.

It is well known to spin a mesophase pitch into a fiber, thermoset the pitch fiber by heating it in air, and carbonize the thermoset pitch fiber by heating the thermoset pitch fiber in an inert gaseous environment to an elevated temperature.

It is preferable to use mesophase pitch rather than isotropic pitch for producing the carbon fibers because the mesophase pitch derived carbon fiber possesses excellent mechanical properties. Furthermore, it is preferable to use a mesophase pitch having a mesophase content of at least about 70% by weight for the process.

Carbon fibers have found a wide range of commercial uses. In certain uses, it is desirable to use carbon fibers which possess both excellent mechanical properties and good electrical conductivity. The electrical conductivity is usually described in terms of resistivity. Typically, a mesophase pitch derived carbon fiber which has been carbonized to a temperature of about 2500° C. has a resistivity of about 7 microohm-meters and a Young's modulus of about 413.6 GPa. The same carbon fiber heat treated to about 3,000° C. has a resistivity of about 3.3 microohm-meters.

The cost for obtaining temperatures of 2,500° C. and particularly 3,000° C. is very high. Not only is it costly to expand the energy to reach the high temperatures, but the equipment needed to reach such high temperatures is costly and deteriorates rapidly due to the elevated temperatures.

The present invention allows the production of a mesophase pitch derived carbon fiber having a resistivity of less than about 2 microohm-meter with a maximum heat treating temperature of from about 2,000° C. to about 2,300° C. and preferably about 1 microohm-meter.

The present invention relates to a mesophase pitch derived carbon fiber which has been boronated and intercalated with calcium.

The preferred embodiment teaches a calcium to boron weight ratio of about 2:1 in the carbon fiber.

In the absence of boron, the calcium does not intercalate into the carbon fiber very well. Even very small amounts of boron enhance the intercalation of the calcium. Generally, 0.1% by weight boron or even less is sufficient to improve substantially the intercalation of calcium into the carbon fibers.

For any given amount of boron in a carbon fiber, the resistivity generally increases as the amount of intercalated calcium increases at the low end, below a calcium to boron weight ratio of 2:1. It is believed that the boron acts as an acceptor and the calcium acts as an electron donor. The interaction between the boron and the calcium is such that a maximum resistivity is reached and then the resistivity is reduced until a minimum is reached for a calcium to boron weight ratio of about 2:1. Apparently high conductivity is associated with the donor state. As the amount of calcium increases so that the ratio is greater than 2:1, the resistivity increases because a multiple phase condition exists.

Generally, if one were to boronate a carbon fiber in the absence of calcium, the maximum amount of boron which could be introduced into the carbon fiber is about 1.2% by weight. The presence of the intercalated calcium, however, substantially increases the maximum amount of boron. It is expected that about 10% by weight or more or boron can be introduced into the carbon fiber in the presence of the intercalated calcium. In addition, it is expected that as much as 20% by weight of calcium can be intercalated into the carbon fiber in the presence of the boron.

Surprisingly, the boron and calcium can be introduced into the carbon fiber without chemically reacting with the carbon fiber so that a single phase is maintained. Heat treatments at elevatted temperatures can result in the formation of a new phase, calcium borographite.

It is believed that the presence of the intercalated calcium results in cross-linking between layer planes in the carbon fiber and improved mechanical properties are obtained. Excellent values for tensile strength and Young's modulus are obtained for the calcium intercalated boronated fibers even though relatively low process temperatures are used. For example, a carbon fiber according to the invention which has been produced using a process temperature of about 2,000° C. possesses mechanical properties comparable to a conventional mesophasse pitch derived carbon fiber which has been subjected to a process temperature of 3,000° C. In addition the carbon fiber according to the invention possesses much lower resistivity compared to the conventional carbon fiber.

Surprisingly, the carbon fiber according to the invention possesses a relatively high interlayer spacing as compared to the typical interlayer spacing of 3.37 Angstroms of a carbon fiber which has been subjected to a heat treatment of about 3,000° C. According to the prior art, one would expect a deterioration of mechanical properties for larger values of interlayer spacing for the carbon fibers. The maximum interlayer spacing occurs for a calcium to boron weight ratio of about 2:1 as in the case for the minimum resistivity.

Generally, about 0.5% by weight boron and about 1% by weight calcium provides a good quality carbon fiber acording to the invention.

The present invention also relates to the method of producing a mesophase pitch derived carbon fiber having a low resistivity and excellent mechanical properties, and comprises the steps of producing a mesophase pitch derived carbon fiber from a mesophase pitch having a mesophase content of at least about 70% by weight mesophase, boronating the fiber, and intercalating the fiber with calcium.

The steps for boronating and intercalating can be carried out simultaneously or consecutively, boronating being first.

The preferred embodiment is to carry out the method to produce a calcium intercalated boronated carbon fiber having a calcium to boron weight ratio of about 2:1.

The boronating can be carried out with elemental boron, boron compounds, or a gaseous boron compound. A calcium compound such as CaNCN can be used. Oxygen containing compounds of calcium are less desirable because of the possible detrimental effect of the oxygen on the carbon fiber.

Boronating up to about 1.2% by weight maintains a single phase in the carbon fiber. Greater amounts of boron tend to produce boron carbide, $B_4C$.

In carrying out the instant invention, the carbon fiber has a diameter of less than 30 microns and preferably about 10 microns.

Further objects and advantages of the invention will be set forth in the following specification and in part will be obvious therefrom without specifically being referred to, the same being realized and attained as pointed out in the claims hereof.

Illustrative, non-limiting examples of the practice of the invention are set out below. Numerous other examples can readily be evolved in the light of the guiding principles and teachings contained herein. The examples given herein are intended to illustrate the invention and not in any sense limit the manner in which the invention can be practiced.

The examples were carried out using mesophase pitch derived carbon fibers having diameters of about 8 microns. The mesophase pitch used to produce the fibers had a mesophase content of about 80% by weight.

The carbon fibers were produced using conventional methods and were carbonized to about 1,700° C. Lower or higher carbonizing temperatures could have been used. The use of carbon fibers made the handling of the fibers simple because of the mechanical properties exhibited by carbon fibers.

The best mode used in the examples simultaneously boronated and calcium intercalated the carbon fibers. This does not preclude the advantage of consecutive treatments for commercial operations. The method used is as follows.

Finely ground graphite, so-called graphite flour, was blended with elemental boron powder. The weight percentage of boron was selected to be about the desired weight percentage for the carbon fibers. This mixture amounted to about 600 grams and was roll-milled for about 4 hours to mix and grind the graphite and boron thoroughly. The mixture was then calcined in an argon atmosphere at a temperature of about 2,500° C. for about one hour. Any inert atmosphere would have been satisfactory.

The boronated graphite flour was blended with CaNCN powder having particles less than about 44 microns to form a treatment mixture. The amount of CaNCN is determined by the amount of calcium to be intercalated.

The weight of the carbon fibers being treated as compared to the amount of the treatment mixture used is very small. As a result, the weight percentage of the boron in the treatment mixture is about the same for the combination of the carbon fibers and the treatment mixture. This simplifies the selection of a predetermined weight percentage of boronating for the carbon fibers.

The amount of calcium intercalation must be determined experimentally by varying the amount of the calcium compound used and the treatment time.

It should be recognized that the vapor pressure of the boron is much lower than the calcium. The boronation is a result of the atomic diffusion whereas the intercalation of calcium is a result of vapor diffusion.

For each example, six carbon fibers were used and each fiber had a length of about 10 cm. Each of the carbon fibers was suspended inside a graphite container using a graphite form. The graphite form maintained the carbon fiber in a preselected position while the treatment mixture was added to the graphite container. The treatment mixture was vibrated around each carbon fiber to obtain a uniform and packed arrangement.

The six graphite containers were placed in a graphite susceptor and heated inductively to a predetermined maximum temperature for about 15 minutes. The furnace chamber was evacuated to about $5\times10^{-5}$ Torr prior to the heat treatment and then purged with argon during the heating cycle. An inert gas other than argon could be used.

The process could be carried out using $BCl_3$, boranes or water soluble salts such as $H_3BO_3$. In addition, $CaCl_2$ could have been used. Of course, a wide range of other compounds for supplying boron and calcium could be realized easily experimentally in accordance with the criteria set forth herein.

EXAMPLES 1 TO 18

Examples 1 to 18 were carried out to obtain about 0.5% by weight of boron in the carbon fibers and varying amounts of intercalated calcium. The maximum temperature for the heat treatment was 2,050° C.

Table 1 shows the results of the Examples 1 to 18. The amount of the intercalated calcium varied from about 0.5% to about 3.6% by weight. The Young's modulus for each of the carbon fibers was extremely high and the tensile strength was also very good. The resistivity showed a minimum of about 1.8 microohm-meters for about 1% by weight calcium. The interlayer spacing, Co/2 was about a maximum for that value.

TABLE 1

| Example | 0.5% Boron Ca in Fiber % | Resistivity μΩ − m | Tensile G Pa | Young's Modulus G Pa | $C_o/2$ Å |
|---|---|---|---|---|---|
| 1 | 0.5 | 2.9 | 2.28 | 448 | 3.4176 |
| 2 | 0.8 | 3.8 | 1.80 | 551 | 3.4217 |
| 3 | 1.0 | 1.8 | 1.33 | 489 | 3.4224 |
| 4 | 0.5 | 3.5 | 1.90 | 545 | 3.4091 |
| 5 | 0.6 | 2.7 | 1.80 | 593 | 3.4158 |
| 6 | 0.7 | 3.6 | 1.88 | 558 | 3.4174 |
| 7 | 0.7 | 4.3 | 1.69 | 648 | 3.4219 |
| 8 | 0.6 | 4.7 | 1.66 | 489 | 3.4229 |
| 9 | 0.8 | 2.9 | 1.58 | 586 | 3.4248 |
| 10 | 0.9 | 1.8 | 1.28 | 614 | 3.4198 |
| 11 | 0.9 | 1.8 | 1.58 | 724 | 3.4133 |
| 12 | 0.9 | 2.0 | 1.43 | 641 | 3.4147 |
| 13 | 1.2 | 1.5 | 1.32 | 634 | 3.4205 |
| 14 | 2.3 | 2.1 | 1.84 | 738 | 3.4174 |
| 15 | 2.0 | 2.3 | 1.48 | 684 | 3.4141 |
| 16 | 2.6 | 1.6 | 1.44 | 662 | 3.4062 |
| 17 | 2.8 | 1.4 | 1.25 | 662 | 3.4082 |
| 18 | 3.6 | 1.8 | 0.79 | 600 | 3.4035 |

EXAMPLES 19 TO 40

Examples 19 to 40 were carried out to obtain about 1.0% by weight of boron in the carbon fibers and varying amounts of intercalated calcium. The maximum temperature for the heat treatment was 2,050° C.

Table 2 shows the results of the Examples 19 to 40. By interpolation, it can be seen that as in Examples 1 to 18, a calcium to boron weight ratio of 2:1 results in the lowest resistivity, about 1.1 microohm-meters, and a large value for the interlayer spacing.

TABLE 2

| Example | 1% Boron Ca in Fiber % | Resistivity μΩ − m | Tensile G Pa | Young's Modulus G Pa | $C_o/2$ Å |
|---|---|---|---|---|---|
| 19 | 1.5 | 4.8 | 1.89 | 641 | 3.4381 |
| 20 | 0.4 | 4.3 | 2.07 | 476 | 3.4120 |
| 21 | 0.5 | 2.3 | 1.98 | 779 | 3.3833 |

TABLE 2-continued

| Example | 1% Boron Ca in Fiber % | Resistivity μΩ − m | Tensile G Pa | Young's Modulus G Pa | $C_o/2$ Å |
|---|---|---|---|---|---|
| 22 | 1.3 | 4.3 | 2.53 | 786 | 3.4348 |
| 23 | 1.1 | 3.3 | 1.85 | 692 | 3.4265 |
| 24 | 1.5 | 2.8 | 1.63 | 745 | 3.4638 |
| 25 | 1.6 | 3.4 | 1.92 | 669 | 3.4564 |
| 26 | 1.8 | 5.0 | 1.96 | 717 | 3.4534 |
| 27 | 1.8 | 4.4 | 2.12 | 689 | 3.4610 |
| 28 | 1.6 | 2.3 | 2.14 | 758 | 3.4540 |
| 29 | 1.8 | 3.0 | 1.52 | 717 | 3.4571 |
| 30 | 2.2 | 1.4 | 1.33 | 627 | 3.4559 |
| 31 | 1.9 | 1.7 | 0.89 | 448 | 3.4488 |
| 32 | 1.9 | 1.1 | 1.54 | 586 | 3.4520 |
| 33 | 3.2 | 2.0 | 0.58 | 340 | 3.4549 |
| 34 | 2.5 | 1.5 | 1.15 | 558 | 3.4461 |
| 35 | 4.7 | 2.3 | 0.41 | 358 | 3.4288 |
| 36 | 4.3 | 2.4 | 0.39 | 338 | 3.4388 |
| 37 | 6.2 | 2.6 | 0.50 | 290 | 3.4394 |
| 38 | 5.4 | 2.0 | 0.50 | 352 | 3.4452 |
| 39 | 6.5 | 1.7 | 0.56 | 462 | 3.4486 |
| 40 | 8.9 | 2.2 | 0.70 | 552 | 3.4392 |

EXAMPLES 41 TO 58

Examples 41 to 58 were carried out to obtain about 2.0% by weight of boron in the carbon fibers and varying amounts of intercalated calcium. The maximum temperature for the heat treatment was 1,600° C.

Table 3 shows the results of Examples 41 to 58.

The values of the resistivity are not as good as the Examples 1 to 40. The lowest resistivity is for calcium to boron weight ratio of about 2:1. The value for the Young's modulus for each carbon fiber is fairly high.

TABLE 3

| Example | 2% Boron Ca in Fiber % | Resistivity μΩ − m | Tensile G Pa | Young's Modulus G Pa | $C_o/2$ Å |
|---|---|---|---|---|---|
| 41 | 0.2 | 7.5 | 2.62 | 400 | 3.4202 |
| 42 | 0.2 | 7.6 | 2.62 | 365 | 3.4242 |
| 43 | 0.3 | 7.7 | 2.48 | 338 | 3.4324 |
| 44 | 0.7 | 7.3 | 2.59 | 393 | 3.4283 |
| 45 | 1.2 | 6.8 | 2.29 | 407 | 3.4179 |
| 46 | 1.8 | 5.8 | 1.98 | 420 | 3.4209 |
| 47 | 2.3 | 7.1 | 1.86 | 427 | 3.4238 |
| 48 | 2.6 | 5.6 | 2.03 | 427 | 3.4383 |
| 49 | 2.6 | 4.0 | 2.38 | 414 | 3.4368 |
| 50 | 3.3 | 4.2 | 1.97 | 400 | 3.4291 |
| 51 | 4.0 | 3.8 | 2.15 | 427 | 3.4483 |
| 52 | 5.1 | 3.8 | 1.96 | 434 | 3.4491 |
| 53 | 5.1 | 3.8 | 1.27 | 400 | 3.4444 |
| 54 | 6.4 | 4.0 | 1.32 | 448 | 3.4559 |
| 55 | 6.8 | 4.2 | 1.63 | 455 | 3.4326 |
| 56 | 8.0 | 4.7 | 1.13 | 420 | 3.4486 |
| 57 | 8.5 | 3.5 | 1.16 | 510 | 3.4381 |
| 58 | 12.5 | 4.2 | 1.23 | 786 | 3.4338 |

EXAMPLES 59 TO 75

Examples 59 to 75 were carried out to obtain about 2.0% by weight of boron in the carbon fibers as in the Examples 41 to 58 except that the maximum temperature for the heat treatment was 2,050° C.

Table 4 shows the results of the Examples 59 to 75.

The Examples 59 to 75 produced much lower values for resistivity than the Examples 41 to 58. The lowest resistivity and highest interlayer spacing can be interpolated to be at a calcium to boron weight ratio of about 2:1. The Young's modulus and tensile strength for each of the carbon fibers is excellent.

TABLE 4

| Example | 2% Boron Ca in Fiber % | Resistivity μΩ − m | Tensile G Pa | Young's Modulus G Pa | $C_o/s$ Å |
|---|---|---|---|---|---|
| 59 | 0 | 2.8 | 2.25 | 689 | 3.381 |
| 60 | 0.7 | 2.5 | 1.60 | 593 | 3.4003 |
| 61 | 3.5 | 2.9 | 1.31 | 689 | 3.5390 |
| 62 | 0.4 | 2.8 | 2.06 | 641 | 3.3964 |
| 63 | 0.6 | 2.9 | 2.12 | 620 | 3.4050 |
| 64 | 0.9 | 2.6 | 2.07 | 738 | 3.4302 |
| 65 | 1.8 | 2.6 | 1.68 | 662 | 3.4489 |
| 66 | 2.9 | 2.8 | 1.60 | 551 | 3.4717 |
| 67 | 3.1 | 2.6 | 2.11 | 586 | 3.4957 |
| 68 | 3.2 | 3.4 | 1.37 | 627 | 3.5077 |
| 69 | 3.5 | 2.5 | 1.73 | 579 | 3.5136 |
| 70 | 3.6 | 2.0 | 1.48 | 579 | 3.5222 |
| 71 | 4.8 | 1.5 | 0.99 | 510 | 3.5293 |
| 72 | 4.5 | 1.8 | 1.25 | 476 | 3.5349 |
| 73 | 5.1 | 1.5 | 1.52 | 565 | 3.5027 |
| 74 | 5.1 | 1.5 | 1.80 | 634 | 3.4930 |
| 75 | 6.6 | 1.8 | 0.97 | 551 | 3.4886 |

EXAMPLES 76 TO 93

Examples 76 to 93 were carried out to obtain about 2.0% by weight of boron in the carbon fibers as in the Examples 41 to 75 except that the maximum temperature for the heat treatment was about 2,300° C.

Table 5 shows the results of the Examples 76 to 93.

The Examples 76 to 93 compare well with the Examples 59 to 75.

TABLE 5

| Example | 2% Boron Ca in Fiber % | Resistivity μΩ − m | Tensile G Pa | Young's Modulus G Pa | $C_o/2$ Å |
|---|---|---|---|---|---|
| 76 | 1.0 | 2.3 | 1.82 | 551 | 3.4385 |
| 77 | 2.5 | 2.5 | 1.15 | 510 | 3.4585 |
| 78 | 1.1 | 2.3 | 0.86 | 420 | 3.3896 |
| 79 | 1.1 | 2.6 | 1.70 | 572 | 3.4410 |
| 80 | 1.4 | 2.4 | 1.63 | 558 | 3.4339 |
| 81 | 1.5 | 2.5 | 1.69 | 724 | 3.4462 |
| 82 | 1.5 | 2.3 | 2.34 | 538 | 3.4405 |
| 83 | 1.4 | 2.3 | 2.29 | 524 | 3.4312 |
| 84 | 2.5 | 2.3 | 2.37 | 696 | 3.4681 |
| 85 | 2.5 | 2.4 | 2.30 | 682 | 3.4671 |
| 86 | 2.5 | 2.3 | 2.30 | 724 | 3.4667 |
| 87 | 2.4 | 2.2 | 2.54 | 731 | 3.4752 |
| 88 | 2.9 | 2.6 | 1.93 | 662 | 3.4913 |
| 89 | 5.1 | 1.2 | 1.90 | 772 | 3.5074 |
| 90 | 6.1 | 1.4 | 1.91 | 689 | 3.4992 |
| 91 | 5.7 | 1.2 | 1.99 | 800 | 3.5232 |
| 92 | 7.0 | 1.2 | 1.69 | 558 | 3.4954 |
| 93 | 8.2 | 1.5 | 1.14 | 517 | 3.5159 |

While a maximum temperature for the heat treatment can exceed 2,300° C., there is a reduction of mechanical properties of the fibers when the maximum temperature exceeds 2,500° C.

EXAMPLES 94 TO 109

Examples 94 to 109 were carried out to obtain about 5% by weight of boron in the carbon fibers. The maximum temperature for the heat treatment was about 2,050° C.

Table 6 shows the results of the Examples 94 to 109.

The Examples 94 to 109 do not include the preferred calcium to boron weight ratio but the trend of resistivity versus calcium content shows the characteristic increase in resistivity for a calcium to boron weight ratio less than 2:1. In addition, the interlayer spacing increases from a calcium content of about 3.8% to 8.5% by weight and would be expected to be a maximum at about 10% by weight in accordance with the invention.

TABLE 6

| Example | 5% Boron Ca in Fiber % | Resistivity μΩ − m | Tensile G Pa | Young's Modulus G Pa | $C_o/2$ Å |
|---|---|---|---|---|---|
| 94 | 0.6 | 2.5 | 1.43 | 531 | 3.3928 |
| 95 | 2.0 | 2.6 | 1.70 | 462 | 3.4435 |
| 96 | 3.2 | 2.6 | 1.27 | 446 | 3.5160 |
| 97 | 2.8 | 2.6 | 1.58 | 572 | 3.4830 |
| 98 | 3.8 | 2.8 | 1.40 | 531 | 3.4822 |
| 99 | 4.3 | 2.8 | 1.61 | 503 | 3.5089 |
| 100 | 2.5 | 2.9 | 2.20 | 689 | 3.5134 |
| 101 | 3.2 | 3.0 | 1.57 | 600 | 3.5134 |
| 102 | 3.9 | 3.3 | 2.21 | 558 | 3.5473 |
| 103 | 4.5 | 3.3 | 1.46 | 579 | 3.5306 |
| 104 | 4.8 | 3.4 | 0.88 | 517 | 3.5367 |
| 105 | 6.7 | 3.0 | 0.37 | 317 | 3.5316 |
| 106 | 7.7 | 3.0 | 0.34 | 290 | 3.5614 |
| 107 | 8.0 | 3.6 | 0.29 | 241 | 3.5721 |
| 108 | 8.0 | 3.4 | 0.49 | 324 | 3.5834 |
| 109 | 8.5 | 6.0 | 0.33 | 186 | 3.6007 |

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A mesophase pitch derived carbon fiber which has been boronated and intercalated with calcium, wherein said fiber contains from about 0.1% by weight to about 10% by weight boron and the calcium to boron weight ratio in said fiber is about 2:1.

2. The carbon fiber of claim 1, wherein the resistivity of said fiber is about one microohm-meter.

3. A method of producing a mesophase pitch derived carbon fiber having a low resistivity and excellent mechanical properties, comprising the steps of:

producing a mesophase pitch derived carbon fiber from a mesophase pitch having a mesophase content of at least 70% by weight mesophase;

boronating said fiber to contain from about 0.1% by weight to about 10% by weight boron; and intercalating said fiber with calcium so that the calcium to boron weight ratio in said fiber is about 2:1.

4. The method of claim 3, wherein said boronating step and said intercalating step are carried out simultaneously.

5. The method of claim 3 wherein said intercalating step is carried out subsequent to said boronating step.

6. The method of claim 3, wherein said boronating step is carried out with elemental boron, $BCl_3$, or boranes, or water soluble compounds of boron.

7. The method of claim 3 wherein said intercalating step is carried out using CaNCN or $CaCl_2$.

* * * * *